United States Patent [19]

Hollweck

[11] 4,307,370

[45] Dec. 22, 1981

[54] HEAT SENSITIVE CIRCUIT BREAKER EMPLOYING MELTABLE MATERIAL

[75] Inventor: Walter Hollweck, Nuremberg, Fed. Rep. of Germany

[73] Assignee: Inter Control Hermann Köhler Elektrik GmbH & Co. KG, Nuremberg, Fed. Rep. of Germany

[21] Appl. No.: 48,479

[22] Filed: Jun. 14, 1979

[30] Foreign Application Priority Data

Jun. 15, 1978 [DE] Fed. Rep. of Germany ..... 2826207

[51] Int. Cl.[3] ..... H01H 37/02

[52] U.S. Cl. ..... 337/299; 337/407

[58] Field of Search ..... 337/401, 403, 407, 408, 337/409, 3, 4, 13, 299

[56] References Cited

U.S. PATENT DOCUMENTS

| | | | |
|---|---|---|---|
| 2,909,631 | 10/1959 | Stamm et al. | 337/13 |
| 3,291,945 | 12/1966 | Merrill et al. | 337/403 |
| 3,624,578 | 11/1971 | Stocker | 337/299 |
| 3,845,440 | 10/1974 | Hunter | 337/3 X |
| 4,020,442 | 4/1977 | Ito et al. | 337/3 X |
| 4,145,654 | 3/1979 | Grimm | 337/403 |

*Primary Examiner*—George Harris

*Attorney, Agent, or Firm*—Spencer & Kaye

[57] ABSTRACT

A heat sensitive circuit breaker for electrical apparatus, composed of an insulated member carrying electrical contacts and contact springs for producing an electric current flow path, a heat transfer plate, a thermal actuator composed of a body of meltable material, and a force-transmitting pin of electrical insulating material which is displaceably mounted in the insulated member and has one end in engagement with the body of meltable material and its other end in engagement with one of the contact springs, in which the meltable material is a solder and the actuator includes a rigid sleeve circumferentially enclosing the solder body and provided at one of its axial ends with an opening via which the solder body is in direct contact with the heat transfer plate, and at the other of its axial ends with an opening through which the pin extends to engage the solder body.

5 Claims, 5 Drawing Figures

HEAT SENSITIVE CIRCUIT BREAKER EMPLOYING MELTABLE MATERIAL

BACKGROUND OF THE INVENTION

The present invention relates to a heat sensitive circuit breaker for electrical apparatus, the circuit breaker being of the type which includes an insulated body having electrical terminals and contact springs to produce an electric current path, a heat transfer plate, an insert of meltable material constituting a thermal actuator, and a force-transmitting pin of insulating material which is displaceably mounted in the insulated portion. One end of the force-transmitting pin is in engagement with the insert and its other end bears against one of the contact springs.

Heat sensitive circuit breakers employing meltable, or fusible, materials are known, one particular form being as disclosed in German Pat. No. 2,012,426, in which an electrically conductive sleeve contains a mass of meltable salt which is connected, via a compression spring, with an electrically conductive component which is displaceable within the sleeve and which produces an electrical connection with an electrical conductor that is otherwise insulated from the sleeve.

When a predetermined temperature is reached, the mass of salt melts, and hence collapses, causing the component to be displaced in the sleeve so as to sever the electrical connection between the sleeve and the electrical conductor.

A drawback of this known structure, however, is that the sleeve carries current and when it is coupled to a heat transfer surface which is usually exposed and hence liable to be touched, it must be electrically insulated in a suitable manner.

This necessary insulation constitutes an additional cost to the user of such heat sensitive circuit breakers. Moreover, differences in heat transfer under different insulation conditions adversely influence the thermal response behavior of such devices.

A further drawback of known devices is the lack of fastening means, since with such heat sensitive circuit breakers fastening can be effected only by means of a clamp for which again the user must provide suitable means.

Other heat sensitive circuit breakers employing meltable materials are known in which contact springs and electrical terminals are disposed in an insulated member and a meltable insert or solder is used as the thermal actuator. A force-transmitting pin of insulating material is displaceably mounted between the solder and the contact springs and acts to separate the contact springs once the solder insert has melted.

In known devices of this type, a solder body in the shape of a circular disc is used as the meltable insert, the disc being placed on a heat transfer plate which has an opening of the size of the force-transmitting pin. When the solder melts, the pin pushes the solder into the opening of the heat transfer plate and the contact springs are separated.

However, due to its poor long-term behavior, this type of device is extremely disadvantageous for use as a heat-sensitive circuit breaker.

Although the solders employed in these devices should have a defined melting point based on their alloy composition, a solder begins to soften before it reaches its melting point. That means that under prolonged exposure to heat at temperatures below the melting point, there occurs a reduction in hardness and a force—for example from the spring tension of the contact spring—can prematurely cause the heat sensitive circuit breaker to be actuated.

Moreover, in known devices there exists the drawback that the solder is exposed. It is known to be possible that various solders experience a shift in their melting point under the influence of oxygen due to oxidation.

SUMMARY OF THE INVENTION

It is therefore an object of the present invention to provide a heat sensitive circuit breaker in which these drawbacks are overcome and which can nevertheless be manufactured economically.

These and other objects are achieved, according to the invention, by the provision of a heat sensitive circuit breaker for electrical apparatus, composed of an insulated member carrying electrical contacts and contact springs for producing an electric current flow path, a heat transfer plate, a thermal actuator composed of a body of meltable material, and a force-transmitting pin of electrical insulating material which is displaceably mounted in the insulated member and has one end in engagement with the body of meltable material and its other end in engagement with one of the contact springs, in which the meltable material is a solder and the actuator includes a rigid sleeve circumferentially enclosing the solder body and provided at one of its axial ends with an opening via which the solder body is in direct contact with the heat transfer plate, and at the other of its axial ends with an opening through which the pin extends to engage the solder body.

According to one preferred embodiment of the invention, the sleeve is provided with openings at its ends so that the solder disposed therein, on the one hand, is in contact directly with the heat transfer plate. In addition, the heat transfer plate simultaneously serves as a fastening piece with which to mount the heat sensitive circuit breaker in an electrical apparatus. On the other hand, the force-transmitting pin of insulating material is arranged in the opening of the sleeve opposite the heat transfer plate so as to be displaceable within the insulated member in such a manner that it is in engagement with both the solder and a contact spring. The latter contact spring is tensioned in the direction toward the insulated member so that when the solder melts the contact springs are separated.

The force-transmitting pin has a thickness, or diameter, which is dimensioned so that the solder disposed in the sleeve can be moved within the sleeve without difficulty.

The dimensions of the pin are selected to assure that when it descends into the sleeve, molten solder can exit from the sleeve only via passages at the sleeve end which faces the heat transfer plate.

When the solder reaches its melting point, the force-transmitting pin, supported by the spring force, enters the sleeve and displaces the molten, low viscosity solder from the sleeve.

The advantage of this arrangement according to the invention is that if the solder softens, before reaching its melting point, due to extended thermal stresses, it will be held in shape by the surrounding rigid sleeve. A reduction in the height of the solder, as it is otherwise usually observed, is thus essentially prevented. Since the spring force of the contact spring presses the sleeve, through the intermediary of the solid solder, against the heat transfer surface, the solder is prevented from escaping at this point before the final melting point is reached. Escape of the solder at the point of contact with the force-transmitting pin is made more difficult in that a temperature drop exists between this point of contact and the heat transfer plate so that at the point of contact with the force-transmitting pin the solder will always be colder and harder than at the heat transfer plate.

With this arrangement according to the invention it is additionally accomplished that during melting of the solder, the transition state, in which the solder has a doughy consistency, is delayed so that the contact spring will open with greater speed.

The arrangement according to the invention is particularly advantageous with respect to oxidation of the solder since the solder is essentially enclosed by the sleeve, the force-transmitting pin and the heat transfer plate. This essentially reduces the access of oxygen and thus the danger of changes in the melting point.

According to a further embodiment according to the invention, the insulated member in which the electrical terminals and the contact springs are fastened and in which the force-transmitting pin for the temperature sensitive circuit breaker is displaceably mounted are constructed so that the same insulated member also accommodates electrical terminals, a contact spring with electrical contacts, and a force-transmitting pin for a thermostat having a bimetal element as the thermal sensor. The heat transfer plate with which the solder is in contact here simultaneously serves to hold the bimetal sensor which, for example, may be shaped—in a known manner—as a curved bimetal snap disc whose height of curvature changes abruptly when there is a change in temperature. The force-transmitting pin transfers the change in the height of curvature to the contact spring so that the contacts are opened or closed.

The advantage of this embodiment is a less expensive manufacture of the thermostat and of the heat-sensitive circuit breaker since they can be installed simultaneously. Moreover, a structural unit containing the thermostat and the heat sensitive circuit breaker is of advantage for the thermal response behavior inasmuch as the temperature to which both units respond is monitored at a common point. Moreover, installation of such a structural unit is less expensive than two separate units, which is of considerable advantage for the user.

DESCRIPTION OF THE PREFERRED EMBODIMENTS

Figure 1:
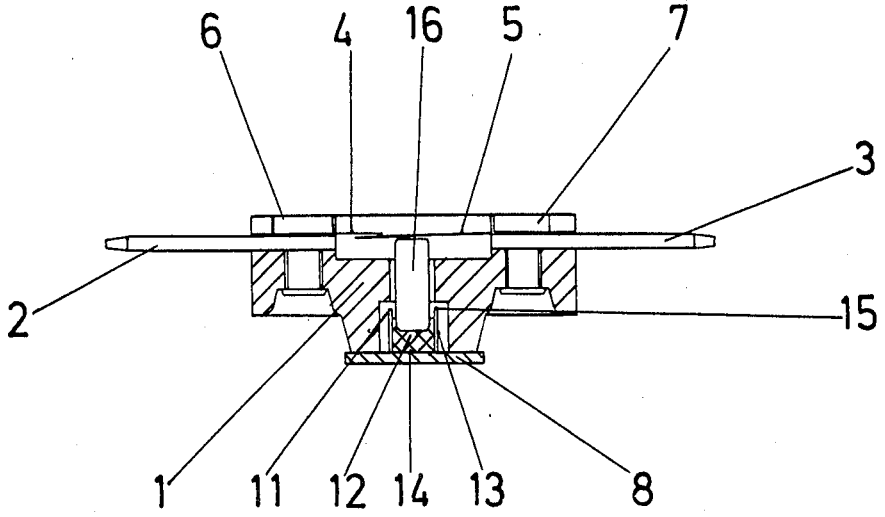
FIG. 1 is a side cross-sectional view of one preferred embodiment of a heat sensitive circuit breaker according to the invention in its initial state.
Figure 2:
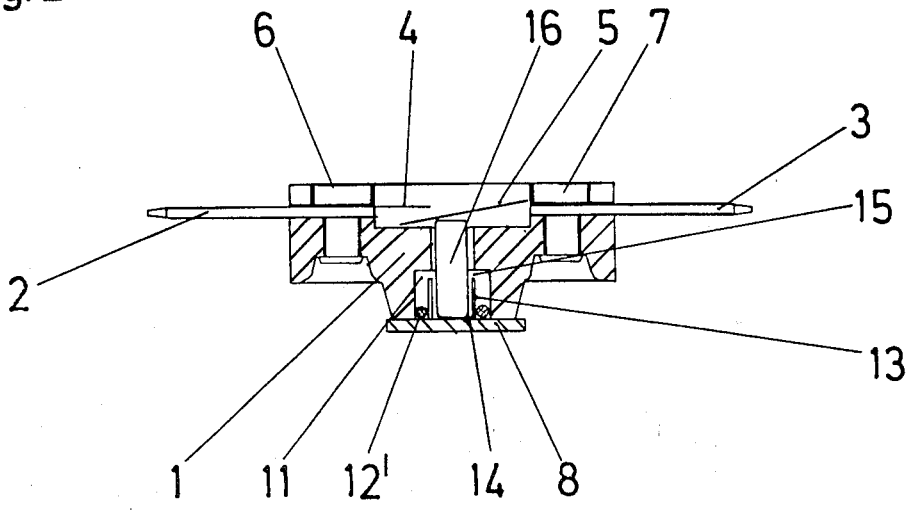
FIG. 2 is a view similar to that of FIG. 1 showing the circuit breaker after it has been actuated.
Figure 3:
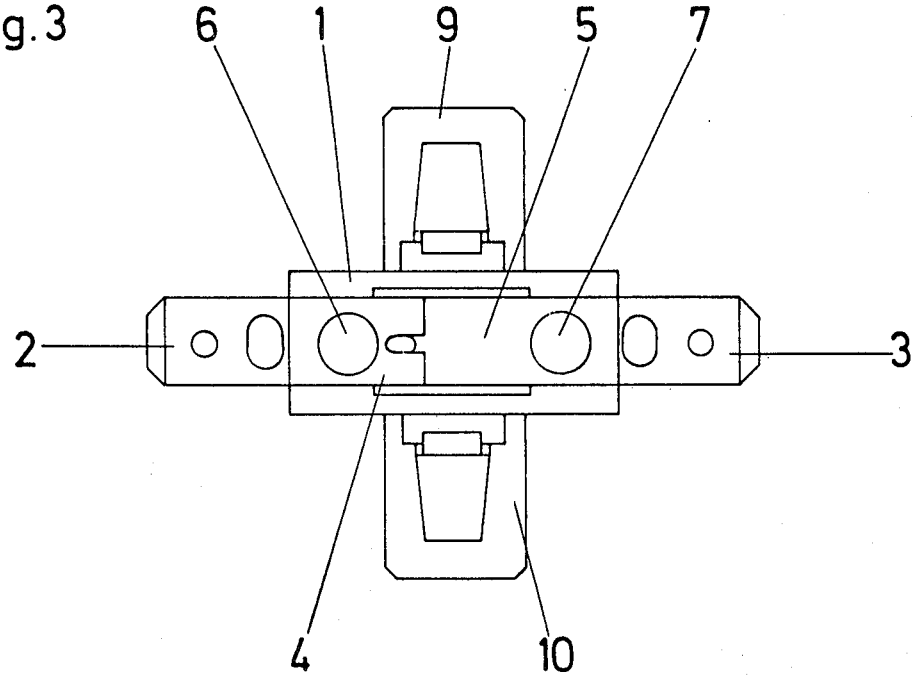
FIG. 3 is a top plan view of the embodiment shown in FIGS. 1 and 2.

The circuit breaker shown in FIGS. 1–3 is composed of a body 1 of electrical insulating material to which terminals 2 and 3 and contact 4 and 5 are permanently attached by means of rivets 6 and 7, respectively, each rivet fastening one terminal and one spring. A heat transfer plate 8, which simultaneously serves as a fastening plate having lateral tabs 9 and 10 (FIG. 3) to mount the device in an electrical instrument, is attached to the insulated body 1 at the side thereof opposite the contact springs 4 and 5.

A solder insert 12 enclosed around its circumference by a rigid, e.g. cylindrical, sleeve 13, is disposed in a recess 11 in the insulated body 1. The sleeve 13 is provided at its lower end with an opening 14 via which the solder mass 12 is in direct contact with the heat transfer plate 8. Sleeve 13 is also provided at its upper end with an opening 15 which is directed away from heat transfer plate 8 and through which the force-transmitting pin 16 of insulating material extends so as to be in engagement with the solder mass 12 and with the contact spring 5.

The contact spring 5 is tensioned, or prestressed, to tend to deflect in the direction toward the interior of insulated body 1 so that when the solder 12 mass melts, the contact springs 4 and 5 are separated.

If the solder 12 reaches its melting point, the force-transmitting pin 16, urged by the spring force provided by the tensioned contact spring 5, enters into the sleeve 13 and displaces the molten solder 12 from the sleeve 13, possibly via a gap between sleeve 13 and plate 8 or openings in the lower end of sleeve 13.

FIG. 2 shows how the molten solder has passed through the opening 14 of the sleeve 13 and is now disposed at 12' in the recess 11 of the insulated body 1. The force-transmitting pin 16 now projects into the sleeve 13 down to the heat transfer plate 8 and the contact spring 5 has fully separated from the contact spring 4.

Figure 4:
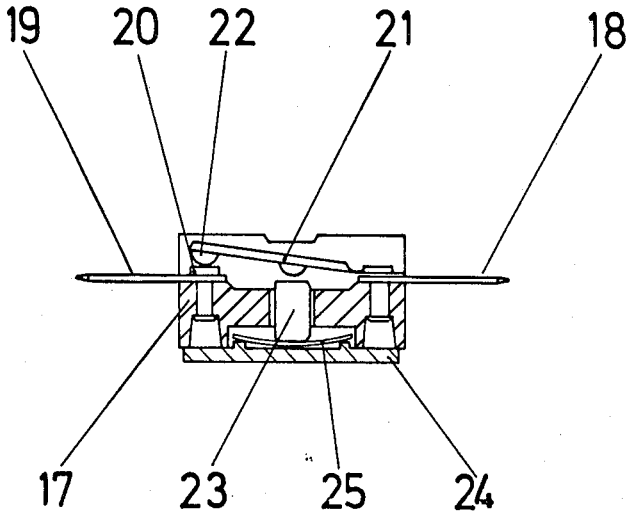
FIG. 4 is a view similar to that of FIG. 1 of a further embodiment of the invention in its initial state.
Figure 5:
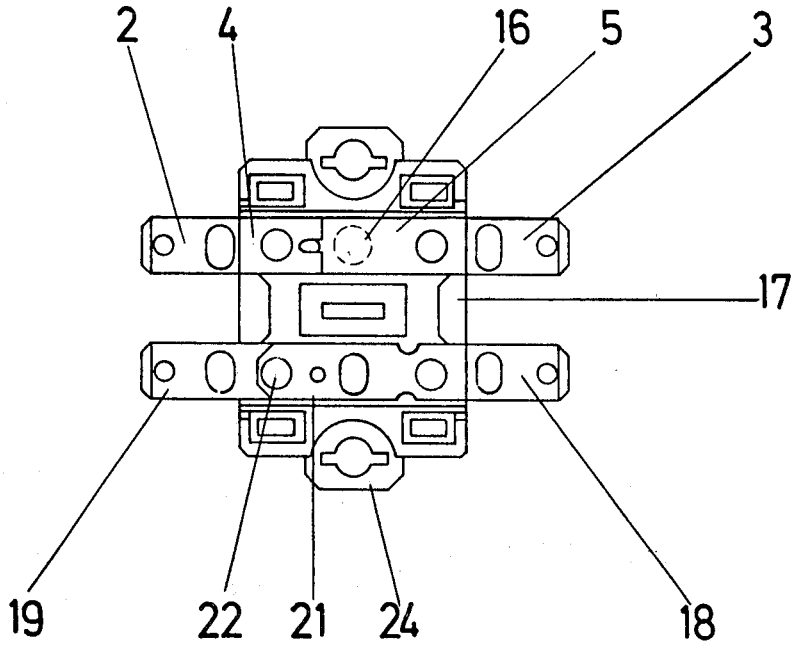
FIG. 5 is a top view of the embodiment of FIG. 4.

According to a further embodiment which is illustrated in FIGS. 4 and 5, an insulated body 17, to which are fastened the electrical terminals 2 and 3 as well as contact springs 4 and 5 and in which the force-transmitting pin 16 for the heat-sensitive circuit breaker is displaceably mounted, is designed in such a manner that the same insulated body 17 also accommodates an electrical terminal 18 associated with a movable electric contact 22 carried by a contact spring 21, and an electrical terminal 19 carrying an electric contact 20, as well as an insulating, force-transmitting pin 23 and a curved, temperature sensitive bimetal disc 25, these components constituting a thermostat. The bimetal disc 25 is disposed in intimate contact with a heat transfer plate 24 and changes its height of curvature when there is a change in temperature. Such changes in the curvature of disc 25 are transmitted to the contact spring 21 via pin 23 to control the opening and closing of contacts 20 and 22. In this device, spring 21 is prestressed to urge contact 22 toward contact 20, but with a force lower than that generated by disc 25 when its temperature varies.

In one typical embodiment, pin 16 can have a diameter which is 0.1 to 0.2 mm smaller than the inner diameter of sleeve 13, and insert 12 could consist of 82.5 percent Pb and 17.5 percent Cd, with a melting point of 248 degrees C.

It will be understood that the above description of the present invention is susceptible to various modifications, changes and adaptations, and the same are intended to be comprehended within the meaning and range of equivalents of the appended claims.

What is claimed is:

1. In a heat sensitive circuit breaker for electrical apparatus, composed of an insulated member carrying electrical contacts and contact springs for producing an electric current flow path, a heat transfer plate, a thermal actuator composed of a body of meltable material, and a force-transmitting pin of electrical insulating material which is displaceably mounted in the insulated member and has one end in engagement with the body of meltable material and its other end in engagement with one of the contact springs, the improvement wherein said meltable material is a solder, said actuator comprises a rigid sleeve provided with openings at its axial ends and circumferentially enclosing said solder body, said solder body is dimensioned to fit firmly in said sleeve in a manner to be held in shape by said sleeve and to be in force-transmitting connection therewith, said insulated member defines a recess surrounding said sleeve, the opening at one axial end of said sleeve is formed to place said solder body in direct contact with said heat transfer plate and to present a passage for flow of molten solder from the interior of said sleeve into said recess, said pin extends through the opening at the other axial end of said sleeve to engage said solder body, and said pin is dimensioned for substantially preventing flow of molten solder between said pin and said sleeve.

2. An arrangement as defined in claim 1 wherein said sleeve is cylindrical.

3. An arrangement as defined in claim 1 or 2 wherein said pin has a thickness which is dimensioned to enable it to be displaceable in said sleeve.

4. An arrangement as defined in claim 3 wherein said solder body is essentially enclosed by said sleeve, said pin and said heat transfer plate.

5. A device comprising:

a heat sensitive circuit breaker composed of an insulated member carrying electrical contacts and contact springs, a heat transfer plate, a rigid sleeve provided with openings at its axial ends, a solder body circumferentially enclosed by said sleeve, dimensioned to fit firmly in said sleeve in a manner to be held in shape by said sleeve and to be in force-transmitting connection therewith, and a force-transmitting pin of insulating material displaceably mounted in said insulated body and having one end in engagement with said solder body and its other end in engagement with one of said contact springs, wherein said insulated member defines a recess surrounding said sleeve, the opening at one axial end of said sleeve is formed to place said solder body in direct contact with said heat transfer plate and to present a passage for flow of molten solder from the interior of said sleeve into said recess, said pin extends through the opening at the other axial end of said sleeve to engage said solder body, and said pin is dimensioned for substantially preventing flow of molten solder between said pin and said sleeve; and a thermostat comprising a first electrical terminal carrying a fixed electric contact, a second electrical terminal carrying a contact spring provided with an electric contact arranged to cooperate with the fixed contact, a second force-transmitting pin, and a bimetal snap disc mounted in thermal communication with said heat transfer plate, said terminals and second pin being disposed in said insulated member and said second pin being disposed for transmitting changes in configuration of said disc to said contact spring.

* * * * *